United States Patent [19]

Burow et al.

[11] 4,109,357

[45] Aug. 29, 1978

[54] YARN SEVERING AND HOLDING APPARATUS

[75] Inventors: Burghard Burow, Radevormwald; Norbert Klinkert, Solingen, both of Fed. Rep. of Germany

[73] Assignee: Barmag Barmer Maschinenfabrik Aktiengesellschaft, Remscheid-Lennep, Fed. Rep. of Germany

[21] Appl. No.: 803,749

[22] Filed: Jun. 6, 1977

[30] Foreign Application Priority Data

Jun. 15, 1976 [DE] Fed. Rep. of Germany ..... 2626651

[51] Int. Cl.[2] ..... B65H 54/80

[52] U.S. Cl. ..... 28/289; 19/159 A; 57/87

[58] Field of Search ..... 57/34 R, 86–87, 57/127; 19/159 A; 28/289

[56] References Cited

U.S. PATENT DOCUMENTS

| | | | |
|---|---|---|---|
| 3,246,371 | 4/1966 | Tooka | 19/159 A |
| 3,354,513 | 11/1967 | Fornes | 19/159 A |
| 3,605,198 | 9/1971 | Mackie | 19/159 A |
| 3,656,383 | 4/1972 | Dibble et al. | 19/159 A X |

*Primary Examiner*—Charles Gorenstein

*Attorney, Agent, or Firm*—Keil, Thompson & Shurtleff

[57] ABSTRACT

A yarn severing and holding apparatus for use in a system for changing spinning cans in which synthetic filamentary yarns are deposited. In this apparatus an arm supported, independently of the can transporting means, for rotation at a level between the yarn feeding device and the cans, has a slide mounted thereon for traversing movement lengthwise of the arm. This slide carries a cutting device and also a device for clamping the severed end of the yarn deposited in the full can. This insures that the cut off end of the yarn cannot drop back into the full can and that on the other hand the free end can drop into the still empty can immediately after the cutting operation. Moreover, the severing and holding apparatus is physically divorced from the can-transporting means so that the latter may be designed for either rotational or translational movement.

6 Claims, 4 Drawing Figures

YARN SEVERING AND HOLDING APPARATUS

INTRODUCTION

The invention, generally speaking, relates to the deposition of synthetic continuous threads, yarns, slivers, tows, bands or similar filamentary materials hereinafter collectively referred to as synthetic filamentary yarns, in spinning cans. More particularly, the invention relates to spinning can changing systems and, specifically, to yarn severing and holding apparatus for use in such systems.

BACKGROUND OF THE INVENTION

Spinning cans—which are also variously known as receiving cans, depositing cans or feed boxes—are usually open ended, for example cylindrical, containers. The spinning cans may be arranged for uniform rotation about their axis and superimposed on or combined with the rotation of the can there may be a fluctuating "traversing" or reciprocating movement of the can or of a thread guide. A process of this kind has been disclosed for example in German Laid-Open Specification (DAS) No. 1 028 736 wherein a continuous thread or yarn is deposited in spiral shaped paths into a cake-like structure. Another process of the above general kind has been described in German Published Specification (DT-OS) No. 2 427 722.

It is known to arrange spinning can changing systems for at least partially automatic operation and this requires that in the changing of the cans the continuously fed filamentary yarns must also be automatically severed at the full can.

A number of solutions are known for this kind of problem. Thus, in German Published Patent Specification (DT-OS) No. 1 685 580 a device has been described in which, after the can has been completely filled, a depositing board or plate is shoved into the run of the fibers. An edge of this depositing board simultaneously serves as a severing device. The filamentary yarn fed during the can changing operation is collected on this depositing board. If an empty spinning can has been put in place in lieu of the full can, the depositing board is again shoved out of the fiber run and the yarns which have been piled up on the depositing board in the meantime, all drop into the can. A disadvantage of this device is that the severed yarn end drops into the full spinning can so that it can be retrieved only with great difficulty. A further drawback of the device resides in that in stripping off the material collected on the depositing board, entanglements may occur which may later, upon the drawing of the yarn from the can, lead to the formation of knots in the strand of yarn.

Also known is German Pat. No. (DT-PS) 1 091 010 in which the yarn is ruptured incident to its transfer from one can to the other. This, however, applies to yarns consisting of short, relatively loosely adhering fibers particularly natural fibers. In the case of filamentary yarns which consist of synthetic continuous fibers, this procedure is impossible.

Further known is Laid-Open German Patent Specification (DT-AS) No. 2 035 020 in which three cans are placed on a turntable. Between each of the cans there is provided a roof-shaped member in the form of a support element. In the rotational axis of the turntable there is provided a stationary outrigger arm or boom with a cutting off device in such a way that the arm does not impede the run of the yarn. During the can changing action the filamentary yarn comes to lie across the roof-shaped member due to the rotation of the turntable. After the changing operation has been completed, that is, when the empty can stands under the yarn feeding device the cutting off device is lowered onto the roof-shaped member and the yarn is severed. During the cutting operation the yarn is held by two spring-loaded clamping members respectively attached to the two sides of the cutting device. Thereupon the cutting off device is lifted again and during the final portion of the return stroke of the cutting device the two associated clamping members release the corresponding free ends of the yarn, thereby permitting them to drop back into the respective cans.

Here, too, it is disadvantageous that the severed filamentary yarn, that is, one end thereof, drops back into the filled can. Also, it is only subsequent to the lifting of the boom that the other end of the filamentary yarn is released and drops into the can, that is, at a time when this can is already being loaded and when several layers have already been fed into this can in the meantime; this may also lead to difficulties upon drawing off of the filamentary yarn from the can. Another drawback of this known cutting off and holding device is that it requires the cans to be guided in an arcuate path.

OBJECTS AND SUMMARY OF THE INVENTION

It is accordingly the general object of the invention to provide, in a system for changing spinning cans in which synthetic filamentary yarns are deposited, an improved yarn severing and holding apparatus which avoids some or all of the aforementioned disadvantages.

More particularly it is an object of the invention to provide in such a can changing system an improved yarn severing and holding apparatus in which upon severing of the filamentary yarn the cut off end is prevented from dropping back into the can.

It is another object of the invention to provide in a can changing system of the kind mentioned, an improved yarn severing and holding apparatus of simple design and especially one which requires only a minimum of parts regardless of the type of can transporting means used.

Briefly, in the severing and holding apparatus described herein the foregoing objects are met by providing this apparatus with an arm which extends horizontally between the yarn feeding device and the cans and is rotationally supported independently of the can transporting means; and with a slide which is mounted on the arm for traversing movement lengthwise thereof and which carries a yarn severing device and also a device for holding the severed end of the yarn deposited in the full can.

With the severing and holding apparatus according to the invention it is no longer possible that the cut off end drops back into the full can. At the same time it is insured that immediately after the cutting operation the free end can drop into the still empty can. In this manner the can is continuously filled so that entanglements or knot formations are kept from occurring. Furthermore, the severing and holding apparatus is physically divorced from the can transporting means and, as a result it does not matter whether the cans are provided on a turntable or whether they are continuously supplied by a conveyor belt. Likewise it is advantageous that in the apparatus according to the invention the cutting off function and clamping function are carried out simultaneously by the same moving part so that the manufacturing costs and the control expenses of the apparatus are minimized.

According to a preferred feature of the invention the severing device employs a knife adjustably mounted on one long side of the slide, and the holding device uses a pressure element mounted on the other side of the slide. In this manner the apparatus can be adapted for use with various kinds of fibers and possible wear of individual elements can be compensated for without the device becoming inoperative.

In order to insure that the slide can be traversed fast enough, it is proposed according to another feature of the invention, to employ a pneumatic device for this purpose; rodless cylinder-piston units generally known under the name "ORIGA" may suitably be used; and in order to keep the expense for the control of this device at a minimum, it is further proposed to control the pneumatic device as a function of the arm position.

According to yet another feature of the invention a variable speed transmission is employed for rotating the arm by 360°. The variable speed transmission is put in operation — substantially simultaneously with the can transporting means — in dependence on the degree of fullness of the spinning can or, alternatively, by the operating personnel. In this fashion, too, low control cost and substantial independence of the type of can transporting means employed are insured.

A further advantage of the invention resides in the fact that it permits the use of a single yarn severing and holding apparatus for a multiplicity of spinning cans.

BRIEF DESCRIPTION OF THE DRAWINGS

A preferred embodiment of the invention will now be described with reference to the accompanying drawings, in which.

DETAILED DESCRIPTION

Figure 1:
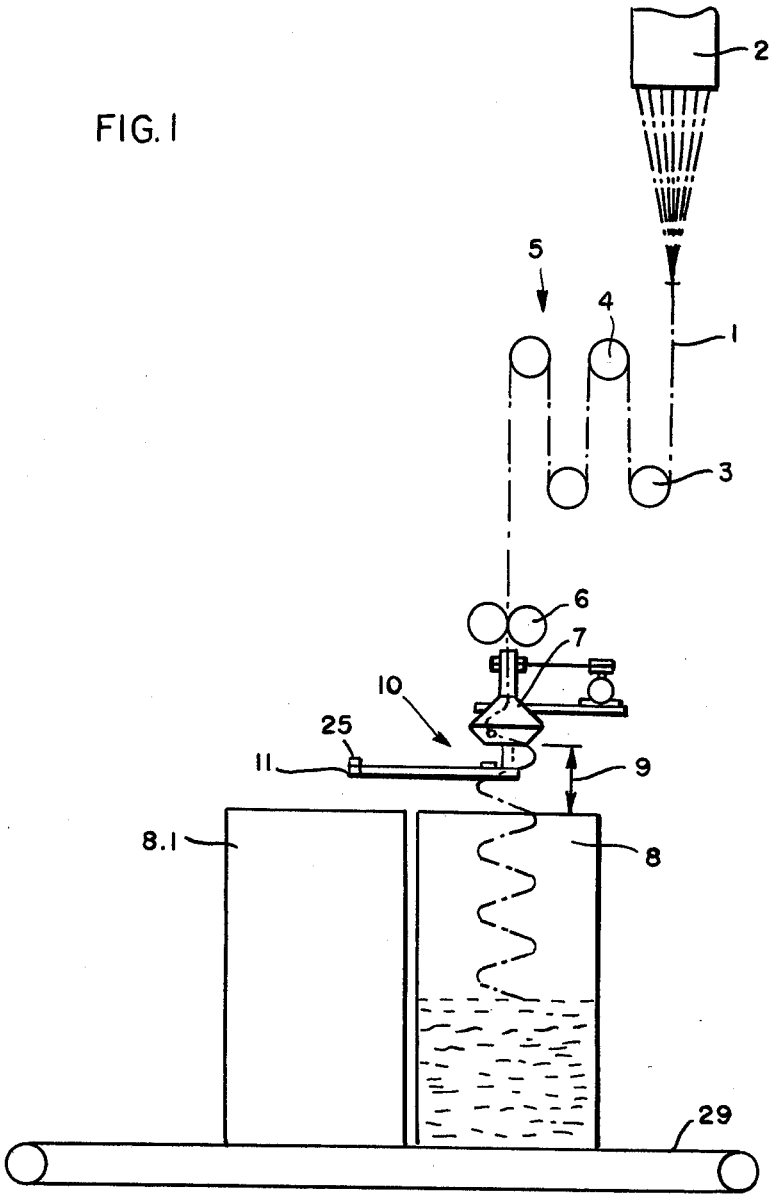
FIG. 1 is a schematic representation of a filamentary yarn spinning system.
Figure 2:
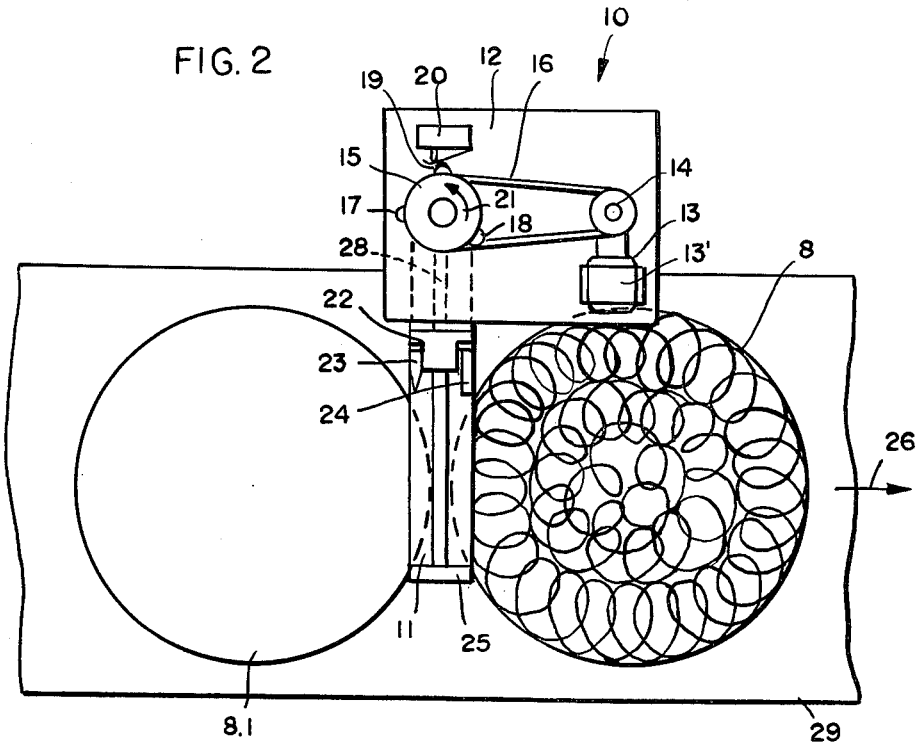
FIG. 2 is a top view of the filamentary yarn clamping and cutting means according to the invention.

In FIG. 1 a filamentary yarn spinning system has been schematically shown. Filamentary yarn 1 is drawn off the spinning jet 2 by means of godets 3 and 4. The yarn then passes, for example, a stretching apparatus 5 and it is then supplied to in-feeding godets 6. These in-feeding godets convey the filamentary yarn into a deflection device 7 employing a rotatably mounted, spatially curved guide tube. By means of this deflection device the rectilinearly supplied filamentary yarn is deflected into a helical course whereupon it drops in free fall into the spinning can. Deflection or "piddling" devices of this kind are known in the art. Reference is made for example to allowed U.S. Patent Application, Ser. No. 670,142, filed on Mar. 25, 1976, by B. Burow on a "Guide Apparatus for Deflecting a Linear Structure". The spinning can 8 may be either round or angular and it may be traversable or stationary. At a distance 9 from deflecting device 7 yarn severing and holding apparatus 10 is mounted, rearwardly displaced with respect to the can as shown in FIG. 2. Apparatus 10 must be designed in such a way that pulley 15, together with arm 11, can be rotated by 360° and that in the course of such rotation arm 11 can be brought into the position shown in FIG. 2, in which it is located underneath deflecting device 7 in line with that device.

In FIG. 2 a top view of the yarn severing and holding apparatus 10 is shown, in which the transporting or conveying means 29 for spinning can 8 is also visible. Drive motor 44, FIGS. 3 and 4, for this transporting means has not been illustrated in FIG. 2. In FIG. 2 apparatus 10 is shown in the position in which it just crosses the vertical extension of the rotational axis of deflection device 7.

Yarn severing and holding apparatus 10 comprises L-shaped arm 11 which is mounted for rotation in housing 12. The arm is rotated by means of motor 13' and variable speed transmission 13, by way of V-belt 16 running over V-belt pulleys 14 and 15. On V-belt pulley 15 three adjustable switching cams 17, 18 and 19 are mounted on three planes. These switching cams actuate microswitches 20, 20.1 and 20.2, FIG. 4. Of these switches only microswitch 20 is visible in FIG. 2 as the other two switches, as viewed in this figure, are disposed behind microswitch 20. The direction of rotation of V-belt pulley 15 has been indicated by arrow 21.

A slide 22 is carried by arm 11 for rectilinear traversing movement. This slide is driven by a cylinder piston unit 28. Rodless cylinder piston units known under the name "ORIGA" are particularly suitable for this purpose because of their small size. These cylinder piston units are obtainable from ORIGA CYLINDRAR AB, Kingsor, Sweden. It may be mentioned that one example for the use of such units has been described in U.S. Patent Application, Ser. No. 785,854, filed on Apr. 8, 1977, by E. Lenk et al on "Bobbin Elevators in Bobbin Transport Devices". On slide 22 cutting device 23 and holding device or pressure element 24 are mounted one behind the other as viewed in FIG. 2 in the direction 26 of can transporting means 29. Cutting device 23 and holding device 24 are mounted individually adjustable in the slide traversing direction. At its free end arm 11 comprises an upstanding plate 25 which serves as an abutment element for holding device 24 as well as for cutting device 23.

Figure 4:
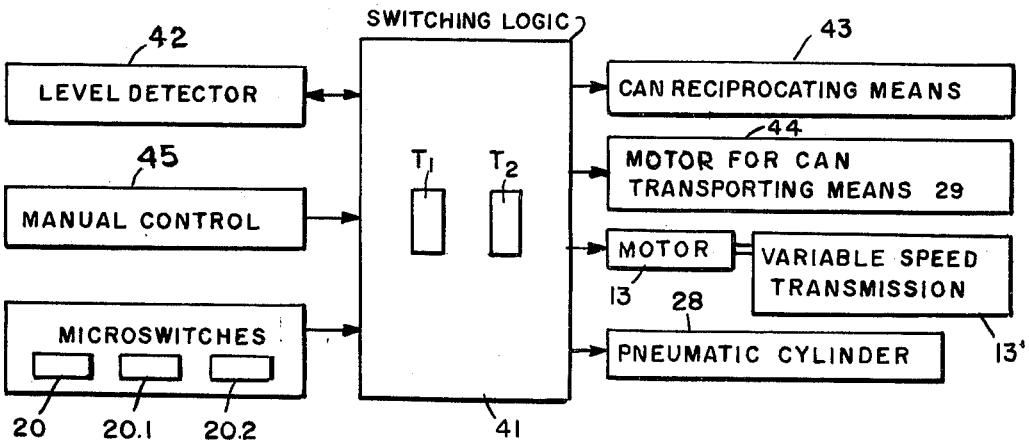
FIG. 4 is a simplified circuit diagram schematically illustrating the switching logic and its connection to the various input and output devices of the system.

The operation of the can changing arrangement according to the invention shall now be more fully described with reference to FIG. 2, flow chart diagram, FIG. 3, and schematic circuit diagram FIG. 4. FIG. 4 shows switching logic 41 in its connection to the various system units controlling it or controlled thereby, in block diagram form; and in flow chart diagram FIG. 3 the resulting changes in the operating conditions of the various equipment units of the system have been illustrated as related to the switching pulses (SI 1, SI 2, etc.) occurring at various times in the operation of the switching logic. In FIG. 4 time delay elements T1, T2, FIG. 3, which form part of the switching logic have been indicated but other than that the details of the logic have, for the sake of simplicity, not been shown in FIG. 4 as any suitable — electrical and/or pneumatic — implementation of the logic which provides the functions reflected by FIG. 3, will be readily apparent to those skilled in the art.

Figure 3:
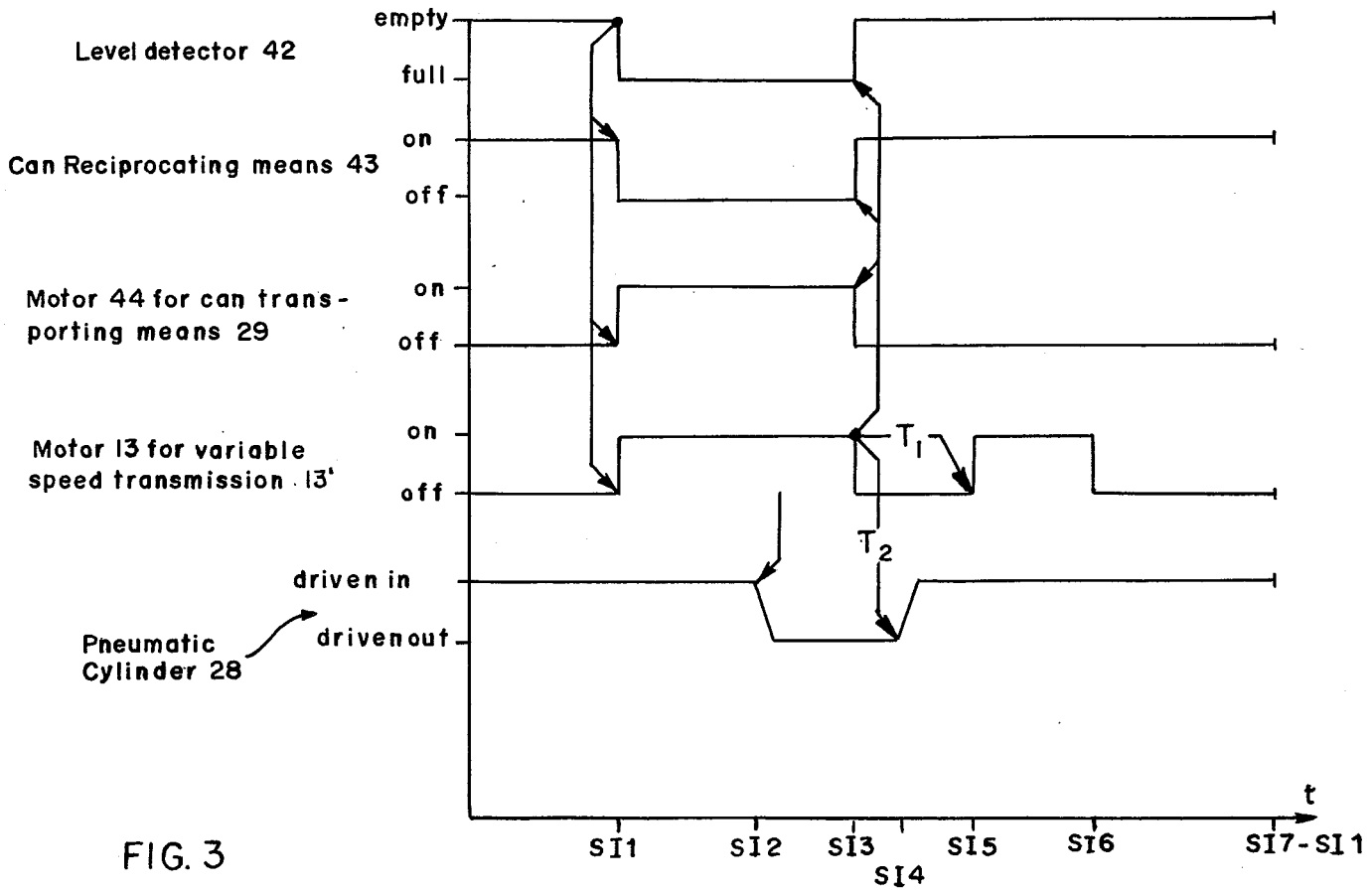
FIG. 3 is a flow chart illustrating the coordination of the individual operational sequences.

In FIG. 3 it has been assumed that an empty can 8 has been driven by transporting means 29 underneath deflection device 7. The can is filled with filamentary yarn 1 deposited in loops. Arm 11 is in its rest position, that is, switching cam 17 depresses microswitch 20 so that motor 13 does not receive any current. When can 8 has been filled, this is being indicated by a suitable indicating means — for example a level counter or a counting means for the detection of the supplied filamentary yarn lengths. This indicating means shown as level detector 42 in FIGS. 3 and 4, causes switching impulse SI1 to be triggered. As a result of this impulse switching logic 41, FIG. 4, causes the traversing or reciprocating means 43, if provided, of the spinning can to be terminated (not shown in the drawings) and motor 44 of transporting means 29 and motor 13 of yarn severing and holding apparatus 10 to be turned on. The speeds of these two drives which are thus started substantially simultaneously are timed with respect to each other in such a way that arm 11, at the moment it crosses the filamentary yarn (FIG. 2), has arrived exactly between the two spinning cans, that is, full can 8 and empty can 8.1. Immediately after crossing of the fiber run microswitch 20.2 is actuated by cam 19 (SI2) so that slide 22 moves into a position where devices 23 and 24 abut against plate 25 and is arrested there. The filamentary yarn 1 is cut by severing device 23. The severed yarn end of the filled can 8 is clamped between holding device 24 and abutment plate 25.

Due to the fact that arm 11, at the time it crosses the fiber run is positioned exactly over the space between the two cans 8 and 8.1 the filamentary yarn is prevented from dropping into this space. Another result of this is that the filamentary yarn is placed over the arm only once so that the yarn is kept from being severed more than once. Inasmuch as the yarn is cut immediately after passing the fiber run it is avoided that the cut off end drops off only after several yarn layers have already been deposited in empty can 8.1.

The can transporting means 29 are continuously moved until empty can 8.1 has been advanced to the point of yarn run. Simultaneously arm 11 has been rotated far enough to reach its waiting position. This position is indicated by the operation of cam 18 of microswitch 20.1 (SI3). Motor 13 is disconnected. Following this the reciprocating means 43 for spinning can 8.1 is switched on. Simultaneously level detector 42 is caused to resume is operation. Now, slide 22 is again driven back (SI 4) by the operating personnel with the aid of manual control 45 or by means of time relay T2. The operating personnel can now secure the freed end of the yarn to spinning can 8 so that this yarn end is prevented from dropping back into the filled can.

After this has been done motor 13 is operated (SI 5) by means of time relay T1, or by the operating personnel, through the medium of manual control 45, so that arm 11 is rotated back into its initial position. In this position cam 17 actuates microswitch 20 (SI 6).

After spinning can 8.1 has been filled, the above described operating cycle is again resumed.

In the above description it has been stated that motor 44 of transporting means 29 and motor 13 of yarn severing and holding apparatus 10 are timed with respect to each other in such a way that arm 11, at the moment it crosses the filamentary yarn, arrives midway between the two spinning cans. Variable speed transmission 13' is provided to insure this result even though cans of different size may be used — which, in turn, affects the time it takes to transport an empty can to the position of a full can; for this reason the rotating speed of the arm must be changed correspondingly. In order to maintain synchronism between the two drives a control connection (not shown in FIG. 4) could be provided between the drive of can transporting means 29 and the drive of arm 12; however, in practice such a synchronizing connection can be dispensed with.

It may be added that in the above description of the operation of this system the assumption has been spelled out that motor 44 of transporting means 29 and motor 13 of apparatus 10 are started substantially simultaneously. However, this too is not a necessary requirement as long as the operations of the two drive means are started in a predetermined mutual time relationship. Thus, it would be possible to design the drive of apparatus 10 in such a way that arm 11 will reach the position shown in FIG. 2 even when it is started ahead of, or later than, the drive of the can transporting means.

We claim:

1. In a spinning can changing system including a depositing device which rotates about a vertical axis, for depositing continuously fed synthetic filamentary yarn, a plurality of spinning cans and means for horizontally transporting said cans so as to move a full can away from, and an empty can into, an operative position underneath said depositing device, a yarn severing and holding apparatus, said apparatus including:

an arm horizontally extending between said depositing device and said cans and supported for rotation, independently of the drive of said can transporting means, about a stationary vertical axis disposed outside of the range of rotational movement of the depositing device, and a slide mounted on said arm for traversing movement lengthwise thereof, said slide carrying a severing device and also a holding device for holding the severed end of the yarn leading toward the full can.

2. In a spinning can changing system a yarn severing and holding apparatus as claimed in claim 1, wherein the severing device comprises a knife adjustably mounted on the leading side of the slide as viewed in the direction of movement of said arm, and wherein the holding device comprises a pressure element mounted on the other side of the slide.

3. In a spinning can changing system a yarn severing and holding apparatus as claimed in claim 2 wherein said arm is provided at its end with a vertically extending abutment member cooperating with said severing device as well as with said holding device.

4. In a spinning can changing system a yarn severing and holding apparatus as claimed in claim 1, wherein said arm carries a cylinder-piston unit for traversing said slide, and wherein there are provided means for controlling the operation of said unit in accordance wih the rotary position of said arm.

5. In a spinning can changing system a yarn severing and holding apparatus as claimed in claim 1, wherein there is provided, a first drive means for said can transporting means, a second drive means, including a variable speed transmission, for rotating said arm by 360°, and means for initiating the operation of said first and second drive means in a predetermined mutual time relationship, the speed of said two drive means being correlated so that said arm arrives in its operative position beneath said depositing device at the moment when the two cans have been advanced to substantially equidistant positions on either side of the rotational axis of said depositing device.

6. In a spinning can changing system a yarn severing and holding apparatus as claimed in claim 5, wherein said initiating means comprise means for starting said first and second drive means substantially simultaneously.

* * * * *